United States Patent [19]

Aoyama et al.

[11] Patent Number: 4,776,929

[45] Date of Patent: Oct. 11, 1988

[54] PROCESS FOR PRODUCTION OF QUATERNARY AMMONIUM HYDROXIDES

[75] Inventors: Tetsuo Aoyama; Eiji Shima; Jiro Ishikawa; Naoto Sakurai, all of Niigata, Japan

[73] Assignee: Mitsubishi Gas Chemical Company, Inc., Tokyo, Japan

[21] Appl. No.: 120,150

[22] Filed: Nov. 12, 1987

[30] Foreign Application Priority Data

Nov. 25, 1986 [JP] Japan ..... 61-278753
Nov. 25, 1986 [JP] Japan ..... 61-278754
Nov. 25, 1986 [JP] Japan ..... 61-278755

[51] Int. Cl.[4] ..... C25C 1/00
[52] U.S. Cl. ..... 204/59 R; 204/73 R
[58] Field of Search ..... 204/59 R, 73 R

[56] References Cited

U.S. PATENT DOCUMENTS 4,326,932 4/1982 Fröling et al. ..... 204/73 R

*Primary Examiner*—R. L. Andrews
*Attorney, Agent, or Firm*—Frishauf, Holtz, Goodman & Woodward

[57] ABSTRACT

A process for production of high purity quarternary ammonium hydroxides, comprising electrolyzing quarternary ammonium hydrogencarbonates represented by the general formula:

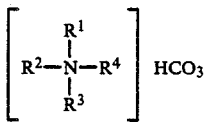

(wherein the symbols are as defined in the appended claims) in an electrolytic cell comprising an anode compartment and a cathode compartment defined by a cation exchange membrane. In accordance with this process, high purity quarternary ammonium hydroxides can be produced with high electrolytic efficiency and further without causing corrosion of equipment. Since the quarternary ammonium hydroxides produced by the present invention are of high purity, they can be effectively used as, for example, cleaners, etchants or developers for wafers in the production of IC and LSI in the field of electronics and semiconductors.

33 Claims, No Drawings

PROCESS FOR PRODUCTION OF QUATERNARY AMMONIUM HYDROXIDES

BACKGROUND OF THE INVENTION

1. Field of the Invention

The present invention relates to a process for the production of quaternary ammonium hydroxides. More particularly, it is concerned with a process for producing high purity quaternary ammonium hydroxides by electrolyzing quaternary ammonium hydrogencarbonates.

2. Description of the Prior Art

Quaternary ammonium hydroxides are widely used in the electronics and semiconductor industry, specifically as cleaners, etchants, developers, etc. for wafers in the production of integrated circuits (IC) and large scale integrations (LSI).

With a recent increase in the degree of integration in semiconductors, it has been increasingly demanded to increase the purity of chemicals for use in the production thereof.

Quaternary ammonium hydroxides are not an exception to the requirement for purity. Thus, in order to increase the purity of quaternary ammonium hydroxides, the starting materials for use in production thereof and a process for the production thereof have been investigated.

For electrolytic production of quaternary ammonium hydroxides, many methods have been proposed, including those as described in, for example, Japanese Patent Publication Nos. 28564/1970, 14885/1971, Japanese Patent Application Laid-Open Nos. 155390/1982, 181385/1982, 193287/1984, 193288/1984, 193228/1984, 100690/1985, 131985/1985 and 131986/1985.

In the above methods, as quaternary ammonium salts to be subjected to hydrolysis, quaternary ammonium halides, quaternary ammonium sulfates, etc. are mainly used. However, when quaternary ammonium halides are used, part of halogen ions pass through the cation exchange membrane and enter the cathode compartment, thereby contaminating the final product of quaternary ammnium hydroxides and, therefore, high purity quaternary ammonium hydroxides are difficult to produce. Furthermore, halogen gas is generated during the electrolysis, thereby causing problems such as corrosion of the anode itself. Since the halogen gas generated is harmful, it is necessary to install equipment for removal or neutralization of the halogen gas.

When quaternary ammonium sulfates are used as the starting material, problems arise in that they are difficult to handle, and sulfuric acid formed during the electrolysis corrodes the electrodes and equipment. Thus, high purity quaternary ammonium hydroxides are difficult to produce from quaternary ammonium sulfates.

When quaternary ammonium organic carboxylic acid salts as described in Japanese Patent Application Laid-Open No. 100690/1985 are used as the starting material, organic carboxylic acids are formed during the electrolysis, which may undesirably corrode the anode itself. Furthermore, part of the organic carboxylic acids may pass through the cation exchange membrane and intermingle with the final product of quaternary ammonium hydroxides, thereby decreasing the purity thereof.

Electrolysis of quaternary ammonium hydrogencarbonates using a diaphragm made of such materials as porcelain, carborundum and arandum is disclosed in Japanese Patent Publication Nos. 28564/1970 and 14885/1981. By the use of such a diaphragm, however, high purity quaternary ammonium hydroxides cannot be obtained, and the method has disadvantages in that the current efficiency is low.

SUMMARY OF THE INVENTION

The present invention is intended to solve the above problems and an object of the present invention is to provide a method of electrolysis whereby high purity quaternary ammonium hydroxides can be produced with high efficiency.

It has been found that high purity quaternary ammonium hydroxides can be produced by electrolysis of quaternary ammonium hydrogencarbonates in an electrolytic cell comprising an anode compartment and a cathode compartment defined by a cation exchange membrane.

The present invention relates to a process for producing high purity quaternary ammonium hydroxides which comprises electrolyzing quaternary ammonium hydrogencarbonates represented by the general formula (I):

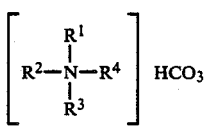

(I)

(wherein $R^1$, $R^2$, $R^3$ and $R^4$ may be the same or different and are each an alkyl group or hydroxyalkyl group having 1 to 8 carbon atoms, an alkoxyalkyl group having 2 to 9 carbon atoms, or an aryl group or hydroxyaryl group) in an electrolytic cell comprising an anode compartment and a cathode compartment defined by a cation exchange membrane.

DETAILED DESCRIPTION OF THE INVENTION

The reaction of the present invention is represented by the following reaction formula.

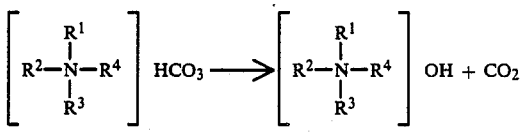

(wherein $R^1$, $R^2$, $R^3$ and $R^4$ are the same as defined above). In accordance with the present invention, therefore, only carbon dioxide gas is formed along with the desired quaternary ammonium hydroxides. That is, neither corrosive substances nor impurities which may cause the contamination of the final product of quaternary ammonium hydroxides are formed during the electrolysis.

Another advantage of the present invention is that the electrolytic efficiency is very high. This high electrolytic efficiency also supports the fact that in accordance with the present invention, the amounts of byproducts formed as impurities are very small as compared with those in the conventional electrolytic methods using other quaternary ammonium salts such as quaternary ammonium halides, sulfuric acid salts and organic carboxylic acid salts. The quaternary ammonium hydrogencarbonates which are used in the present invention are represented by the general formula (I):

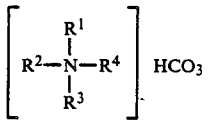

(I)

(wherein $R^1$, $R^2$, $R^3$ and $R^4$ are the same as defined above). Representative examples are tetramethylammonium hydrogencarbonate, tetraethylammonium hydrogencarbonate, tetrapropylammonium hydrogencarbonate, trimethylpropylammonium hydrogencarbonate, trimethylbutylammonium hydrogencarbonate, trimethylbenzylammonium hydrogencarbonate, trimethylhydroxyethylammonium hydrogencarbonate, trimethylmethoxyammonium hydrogencarbonate, dimethyldiethylammonium hydrogencarbonate, dimethyldihydroxyethylammonium hydrogencarbonate, methyltriethylammonium hydrogencarbonate and methyltrihydroxyethylammonium hydrogencarbonate.

Since the object of the present invention is to produce high purity quaternary ammonium hydroxides, it is naturally necessary to use quaternary ammonium hydrogencarbonates which are of high purity, as the starting material.

From the above viewpoint, quaternary ammonium hydrogencarbonates prepared by reacting tertiary amines and dialkyl carbonates or diaryl carbonates in the presence of water (Method A) or by reacting quaternary ammonium monoalkyl carbonates or quaternary ammonium monoaryl carbonates and water (Method B) are preferably used in the present invention because of their high purity.

Methods A and B will hereinafter be explained in detail.

Method A can be represented by the following reaction formula.

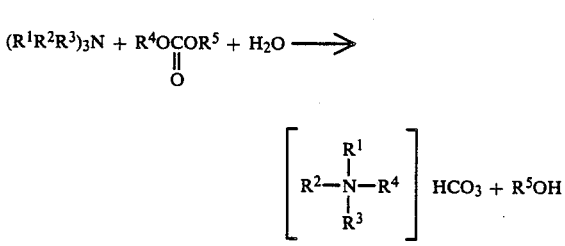

In the above formula, $R^1$, $R^2$, $R^3$ and $R^4$ are the same as defined above, and $R^5$ is an alkyl group having 1 to 8 carbon atoms or an aryl group.

Representative examples of the tertiary amines represented by the above general formula:

$$(R^1R^2R^3)_3N$$

are trimethylamine, triethylamine, tripropylamine, tributylamine, trioctylamine, dimethylethylamine, diethylmethylamine, N,N'-dimethylbenzylamine, N,N'-dimethylaniline, N,N'-dimethylcyclohexylamine, N,N'-diethylbenzylamine, N,N'-dimethylethanolamine, N,N'-diethylethanolamine, N-methyldiethanolamine, triethanolamine, N-methyldiethanolamine and N-ethyldiethanolamine.

Representative examples of the dialkyl carbonates or diaryl carbonates represented by the above general formula:

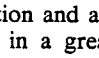

are dimethyl carbonate, diethyl carbonate, dipropyl carbonate, dibutyl carbonate, diphenyl carbonate, dibenzyl carbonate, dicyclohexyl carbonate, methylpropyl carbonate and ethylpropyl carbonate.

In Method A, water is an essential component for the reaction and also acts as a solvent, and thus it can be used in a greater amount than the stoichiometically amount.

The amounts of the above dialkyl carbonates or diaryl carbonates and tertiary amines used vary with the kind of the dialkyl carbonates or diaryl carbonates, the kind of the tertiary amines, reaction conditions and so on. In general, the molar ratio of the dialkyl carbonates or diaryl carbonates to the tertiary amines is 0.05:1 to 20:1 and preferably 0.1:1 to 10:1. It suffices basically that water is added in a stoichiometrically excessive amount in relation to the dialkyl carbonates or diaryl carbonates and tertiary amines. If, however, the amount of water used is too large, the separation and removal of the remaining water after the completion of the reaction needs a longer time, which is not advantageous from an economic standpoint.

In Method A, a polar solvent such as alcohols, nitriles and acid amides can be used. If the polar solvent is used, the rate of reaction at an initial stage of the reaction can be increased and, therefore, the total reaction time can be shortened. Furthermore, the polar solvent has an effect of increasing the reaction yield.

Polar solvents which can be used include aliphatic lower alcohols such as methanol, ethanol and propanol, monovalent aromatic alcohols such as benzyl alcohol, glycols such as ethylene glycol, acid amides such as N,N-dimethylformamide, and nitriles such as acetonitrile. The boiling point of the polar solvent used is preferably not too high; polar solvents having a boiling point within the range of 50° to 200° C. are preferably used. Of these polar solvents, methanol, ethanol, propanol, acetonitrile, etc. are particularly preferred from viewpoints of separation after the completion of the reaction and so on.

In connection with the amount of the polar solvent used, the polar solvent is used in amount of 0.5 to 30 times by weight, preferably 1 to 20 times by weight, more preferably 2 to 20 times by weight to the amount of the dialkyl carbonates or diaryl carbonates, or the tertiary amines.

In Method A, the reaction temperature is generally in the range of 30° to 300° C. In practice, however, the reaction temperature should be determined taking into consideration the rate of reaction, the decomposition of the starting material of dialkyl carbonates or diaryl carbonates and of the reaction product of quaternary ammonium hydrogencarbonates, and so forth. The reaction temperature is usually 40° to 250° C. and preferably 50° to 200° C.

If necessary, the reaction can be carried out in an atmosphere of inert gas such as nitrogen, argon and herium, or hydrogen gas, which do not exert adverse influences on the reaction. The reaction can be carried out batchwise, semibatchwise or continuously.

Method B can be represented by the following reaction formula.

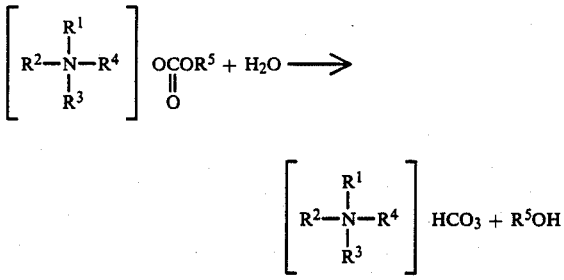

In the above formula, $R^1$, $R^2$, $R^3$, $R^4$ and $R^5$ are the same as defined above.

Representative examples of the quaternary ammonium monoalkylcarbonates or quaternary ammonium monoarylcarbonates represented by the general formula:

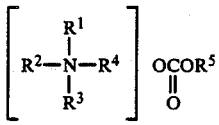

are tetramethylammonium methylcarbonate, tetramethylammonium ethylcarbonate, tetramethylammonium isopropylcarbonate, tetramethylammonium n-butylcarbonate, tetramethylammonium phenylcarbonate, tetramethylammonium benzylcarbonate, tetraethylammonium methylcarbonate, tetraethylammonium ethylcarbonate, tetramethylammonium methylcarbonate, tetrabutylammonium methylcarbonate, trimethylethylammonium methylcarbonate, trimethylpropylammonium methylcarbonate, trimethylpropylammonium propylcarbonate, trimethylbenzylammonium methylcarbonate, trimethylhydroxyethylammonium methylcarbonate, trimethylmethoxyethylammonium methylcarbonate, trimethylethylammonium benzylcarbonate, dimethyldiethylammonium methylcarbonate and the like.

These quaternaryammonium monoalkylcarbonates or quaternaryammonium monoarylcarbonates can be easily prepared, for example as described in U.S. Pat. No. 2,635,100, by reacting dialkyl carbonates or diaryl carbonates with tertiary amines in the presence of a polar solvent such as alcohols.

In Method B, water is one of the starting materials and also acts as a solvent, and thus it is used in a stochiometrically greater amount in relation to the quaternary ammonium alkylcarbonates or quaternary ammonium arylcarbonates used. The molar ratio of water to the quaternary ammonium alkylcarbonates or quaternary ammonium arylcarbonates is preferably 2:1 to 30:1. If, however, water is used in a too large amount, the separation and removal of the remaining water after the completion of the reaction needs a longer time, which is not advantageous from an economic standpoint.

In Method B, a polar solvent such as alcohols, nitriles and acid amides can be used. If the polar solvent is used, the rate of reaction at an initial stage of the reaction can be increased and, therefore, the total reaction time can be shortened. Furthermore the polar solvent has an effect of increasing the reaction yield.

Polar solvents which can be used include aliphatic lower alcohols such as methanol, ethanol and propanol, monovalent aromatic alcohols such as benzyl alcohol, glycols such as ethylene glycol, acid amides such as N,N-dimethylforamide, and nitriles such as acetonitrile. The boiling point of the polar solvent used is preferably not too high; polar solvents having a boiling point within the range of 50° to 200° C. are preferably used. Of these polar solvents, methanol, ethanol, propanol, acetonitriles, etc. are particularly preferred from viewpoints of ease of separation after the completion of the reaction and so on.

In connection with the amount of the polar solvent used, the polar solvent is used in amount of 0.5 to 30 times by weight, preferably 1 to 20 times by weight, more preferably 2 to 10 times by weight to the amount of the quaternary ammonium monoalkylcarbonates or quaternary ammonium monoarylcarbonates.

In Method B, the reaction temperature is generally in the range of 30° to 300° C. In practice, however, the reaction temperature should be determined taking into consideration the rate of reaction, the decomposition of the starting material of quaternary ammonium monoalkylcarbonates or quaternary ammonium monoarylcarbonates and of the reaction product of quaternary ammonium hydrogencarbonates, and so forth. The reaction temperature is usually 40° to 250° C. and preferably 50° to 200° C.

If necessary, the reaction can be carried out in an atmosphere of inert gas such as nitrogen, argon and herium, or hydrogen gas, which do not exert adverse influences on the reaction. The reaction can be carried out batchwise, semibatchwise or continuously.

In the present invention, an electrolytic cell comprising an anode compartment and a cathode compartment defined by a cation exchange membrane is usually used. In addition, an electrolytic cell comprising an anode compartment, a cathode compartment and at least one intermediate compartment defined by at least two cation exchange membranes can be used.

As the cation exchange membrane which is used in the present invention, a membrane made of corrosion resistant fluorine-containing polymers having cation exchange groups such as sulfonic acid groups and carboxylic acid groups in suitable. In addition, those made of styrene-divinylbenzene copolymers having cation exchange groups as described above can be used.

As the anode which is used in the present invention, electrodes commonly used in electrolysis of this type, such as a high purity carbon electrode and a platinum or platinum oxide-covered titanium electrode, are used. As the cathode which is used in the present invention, electrodes commonly used in electrolysis of this type, such as a stainless steel electrode and a nickel electrode, are used. These anode and cathode may be shaped in any desired form such as a plate, a bar, a net and a porous plate.

The electrolytic cell and other equipment such as a reservoir, pipes and valves which are used in the present invention are preferably made of corrosion-resistant materials such as fluorine-containing polymers and polypropylene.

In the present invention, electrolysis is carried out by applying a DC voltage. The current density is 1 to 100 $A/dm^2$ and preferably 3 to 50 $A/dm^2$. The electrolytic temperature is preferably in the range of 10° to 50° C. The electrolysis of the present invention can be carried out batchwise or continuously. The concentration of the starting material in an aqueous solution to be introduced in the anode compartment is adjusted to 1 to 60% by weight and preferably 3 to 40% by weight. In the cathode compartment is introduced ultra pure water. If, however, only ultra pure water is introduced in the cathode compartment, the electric conductance is low at the start of the operation and electrolysis occurs only with difficulty. It is desirable, therefore, that the desired quaternary ammonium hydroxides by added in a small amount, e.g., in a proportion of 0.01 to 5% by weight.

Preferably, prior to the electrolysis, the equipment is fully cleaned. It is also preferred that the electrolysis can be carried out in an atmosphere of clean inert gas such as nitrogen and argon.

The present invention produces various advantages over the conventional methods. One of the major advantages is that high purity quaternary ammonium hydroxides can be easily produced with high electrolytic efficiency. Another advantage is that the problems encountered in the conventional methods, such as corrosion of equipment, can be overcome.

EXAMPLE 1

In an electrolytic cell comprising an anode compartment and a cathode compartment defined by a cation exchange membrane Nafion 324 (trade name, fluorine-containing polymerbased cation exchange membrane produced by E. I. Du Pont de Nemours & Co.), with a platinum-covered titanium electrode as anode and stainless steel (SUS 304) as cathode, a 30% by weight solution of tetramethylammonium hydrogencarbonate in ultra pure water was cycled in the anode compartment, and in the cathode compartment, a 0.5% by weight solution of tetramethylammonium hydroxide in ultra pure water was cycled. Electrolysis was carried out by applying a DC current of 10 A/dm$^2$ between the anode and the cathode at a temperature of 40° C. At an electrolytic voltage of 7 to 11 V and an average current efficiency of 94%, a 4.13% by weight aqueous solution of tetramethylammonium hydroxide was obtained in the cathode compartment.

The concentrations of impurities contained in the aqueous tetramethylammonium hydroxide solution as obtained above are shwwn below.

Na, Fe, K, Ca: 0.001 ppm
Al, Ag, Co, Cr, Mg, Mn, Ni, Zn: Less than 0.001 ppm
Cl: Less than 0.01 ppm

EXAMPLE 2

In the same electrolytic cell as used in Example 1 with the exception that H type Nafion 423 (trade name, fluorine-containing polymer-based cation exchange membrane produced by E. I. du Pont de Nemours & Co.) was used as the cation exchange membrane, a 35% by weight solution of tetramethylammonium hydrogencarbonate in ultra pure water was cycled in the anode compartment, and in the cathode compartment, a 0.5% by weight solution of tetramethylammonium hydroxide in ultra pure water was cycled. Electrolysis was carried out by applying a DC current of 15 A/dm$^2$ between the anode and cathode at a temperature of 40° C. At an electrolytic voltage of 10 to 15 V and an average current efficiency of 93%, a 25.74% by weight aqueous solution of tetramethylammonium hydroxide in the cathode compartment was obtained.

The concentrations of impurities contained in the aqueous tetramethylammonium hydroxide solution as obtained above are shown below:

Na: 0.003 ppm
Fe: 0.005 ppm
K, Ca: 0.001 ppm
Al, Ag, Co, Cr, Cu, Mg, Mn, Ni, Zn: Less than 0.001 ppm
Cl: Less than 0.01 ppm

PREPARATION EXAMPLE 1

The tetramethylammonium hydrogencarbonate used in Examples 1 and 2 was prepared as follows.

604 g of dimethyl carbonate, 394 g of trimethylamine and 250 g of water were introduced in a 3,000-milliliter Tefron-lined reactor and heated with stirring. After the temperature in the reactor reached 100° C., the reaction was continued for 6 hours at 100° C. Tetramethylammonium hydrogencarbonate was obtained in a yield of 90.1 mol % (based on trimethylamine).

EXAMPLE 3

604 g of dimethyl carbonate, 394 g of trimethylamine, 300 g of water and 500 g of methanol were introduced in the same reactor as used in Preparation Example 1 and heated with stirring. After the temperature in the reactor reached 100° C., the reaction was continued for 3 hours at 100° C. Tetramethylammonium hydrogencarbonate was obtained in a yield of 90.3 mol % (based on trimethylamine).

The tetramethylammonium hydrogencarbonate thus obtained was electrolyzed in the same apparatus as used in Example 1 with the exception that a platinum-coated titanium electrode was used as anode and a nickel electrode, as cathode. A 20% by weight solution of tetramethylammonium hydrogencarbonate in ultra pure water was cycled in the anode compartment, and in the cathode compartment, a 1% by weight solution of tetramethylammonium hydroxide in ultra pure water was cycled. Electrolysis was carried out by applying a DC current of 13 A/dm$^2$ between the anode and the cathode at a temperature of 35° C. At an electrolytic voltage of 9 to 14 V and an average current efficiency of 90%, a 23.36% by weight aqueous solution of tetramethylammonium hydroxide was obtained in the cathode compartment.

The concentrations of impurities contained in the aqueous tetramethylammonium hydroxide as obtained above are shown below:

Fe: 0.003 ppm
Na, K, Ca: 0.001 ppm
Al, Ag, Co, Cr, Mg, Mn, Ni, Zn: Less than 0.001 ppm
Cl: Less than 0.01 ppm

EXAMPLE 4

In the same electrolytic apparatus as used in Example 3, a 30% by weight solution of tetraethylammonium hydrogencarbonate in ultra pure water was cycled in the anode compartment, and in the cathode compartment, a 1% by weight solution of tetraethylammonium hydroxide in ultra pure water was cycled. Electrolysis was carried out by applying a DC current of 10 A/dm$^2$ in the anode and the cathode at a temperature of 45° C. At an electrolytic voltage of 7 to 12 V and an average current efficiency of 89%, a 14.95% by weight aqueous solution of tetraethylammonium hydroxide was obtained.

The concentrations of impurities contained in the aqueous tetraethylammonium hydroxide solution as obtained above are shown below:

Fe: 0.005 ppm

Na: 0.003 ppm
K, Al, Ca: 0.001 ppm
Ag, Co, Cr, Mg, Ni, Zn: Less than 0.001 ppm
Cl: Less than 0.01 ppm

PREPARATION EXAMPLE 2

The tetraethylammonium hydrogencarbonate used in Example 4 was prepared as follows.

63 g of diethyl carbonate, 63.4 g of triethylamine and 50.0 g of water were introduced in the same reactor as used in Preparation Example 1 and heated with stirring. After the temperature in the reactor reached 140° C., the reaction was continued for 5 hours at 140° C. Tetraethylammonium hydrogencarbonate was obtained in a yield of 87.9 mol % (based on triethylamine).

PREPARATION EXAMPLE 3

101.6 g of dibenzyl carbonate, 23.6 g of trimethylamine, 60.5 g of water and 20.0 g of methanol were introduced in the same reactor as used in Preparation Example 1 and heated with stirring. After the temperature in the reactor reached 150° C., the reaction was continued for 5 hours at 150° C. Trimethylbenzylammonium hydrogencarbonate was obtained in a yield of 81.0 mol % (based on trimethylamine).

PREPARATION EXAMPLE 4

30.2 g of dimethyl carbonate, 62.1 g of tri-n-butylamine, 30.5 g of water and 15.0 g of methanol were introduced in the same reactor as used in Preparation Example 1 and heated with stirring. After the temperature in the reactor reached 140° C., the reaction was continued for 7 hours at 140° C. Tributylammonium hydrogencarbonate was obtained in a yield of 84.3 mol % (based on tri-n-butylamine).

EXAMPLE 5

In the same electrolytic apparatus as used in Example 3, a 25% by weight solution of tetramethylammonium hydrogencarbonate in super pure water was cycled in the anode compartment, and in the cathode compartment, a 1% by weight solution of tetramethylammonium hydroxide in ultra pure water was cycled. Electrolysis was carried out by applying a DC current of 10 A/dm$^2$ between the anode and the cathode at a temperature of 40° C. At an electrolytic voltage of 7 to 11 V and an average current efficiency of 92%, a 16.68% by weight aqueous solution of tetraethylammonium hydroxide was obtained in the cathode compartment.

The concentrations of impurities contained in the aqueous tetraethylammonium hydroxide solution as obtained above are shown below:

Fe, Na: 0.001 ppm
Al, Ag, Ca, Co, Cr, K, Mg, Mn, Ni, Zn: Less than 0.001 ppm
Cl: Less than 0.01 ppm

PREPARATION EXAMPLE 5

The tetramethylammonium hydrogencarbonate used in Example 5 was prepared as follows.

108.0 g of tetramethylammonium monomethylcarbonate and 72.0 g of water were introduced in the same reactor as used in Preparation Example 1 and heated with stirring. After the temperature in the reactor reached 100° C., the reaction was continued for 3 hours at 100° C. Tetramethylammonium hydrogencarbonate was obtained in a yield of 96.7 mol %.

EXAMPLE 6

108.0 g of tetramethylammonium monomethylcarbonate, 72.0 g of water and 32.0 g of methanol were introduced in the same reactor as used in Preparation Example 1 and heated with stirring. After the temperature in the reactor reached 100° C., the reaction was continued for 3 hours at 100° C. Tetramethylammonium hydrogencarbonate was obtained in a yield of 98.5 mol %.

The tetramethylammonium hydrogencarbonate as obtained above was electrolyzed in the same electrolytic apparatus as used in Example 1 with the exception that a platinum-coated titanium electrode was used as anode, and as cathode, a nickel electrode was used. A 40% by weight solution of tetramethylammonim hydrogencarbonate in super pure water was cycled in the anode compartment, and in the cathode compartment, a 1.5% by weight solution of tetramethylammonium hydroxide in ultra pure water was cycled. Electrolysis was carried out by applying a DC current of 20 A/dm$^2$ between the anode and the cathode at a temperature of 35° C. At an electrolytic voltage of 15 to 23 V and an average current efficiency of 86%, a 22.11% by weight aqueous solution of tetramethylammonium hydroxide was obtained in the cathode compartment.

The concentrations of impurities contained in the aqueous tetramethylammonium hydroxide as obtained above are shown below:

Na: 0.005 ppm
Fe: 0.004 ppm
Ni: 0.003 ppm
Ca, K, Zn: 0.002 ppm
Al: 0.001 ppm
Ag, Co, Cr, Mg, Mn: Less than 0.001 ppm
Cl: Less than 0.01 ppm

EXAMPLE 7

In the same electrolytic apparatus as used in Example 3, a 25% by weight solution of trimethylbenzylammonium hydrogencarbonate in ultra-pure water was cycled in the anode compartment, and in the cathode compartment, a 1% by weight solution of trimethylbenzylammonium hydroxide in ultra pure water was cycled in the cathode compartment. Electrolysis was carried out by applying a DC current of 15 A/dm$^2$ between the anode and the cathode at a temperature of 45° C. At an electrolytic voltage of 11 to 16 V and an average current efficiency of 89%, a 14.65% by weight aqueous solution of trimethylbenzylammonium hydroxide was obtained in the cathode compartment.

The concentrations of impurities in the aqueous trimethylethylammonium solution as obtained above are shown below:

Na: 0.003 ppm
Fe: 0.002 ppm
Ca, K, Ni: 0.001 ppm
Al, Ag, Co, Cr, Mg, Mn, Zn: Less than 0.001 ppm
Cl: Less than 0.01 ppm

PREPARATION EXAMPLE 6

The trimethylbenzylammonium hydrogencarbonate used in Example 7 was prepared as follows.

112.5 g of trimethylbenzylammonium monomethylcarbonate and 55.0 g of water were introduced in the same reactor as used in Preparation Example 1 and heated with stirring. After the temperature in the reactor reached 120° C., the reaction was continued for 3 hours at 120° C. Trimethylbenzylammonium hydrogencarbonate was obtained in a yield of 95.7 mol %.

EXAMPLE 8

In the same electrolytic apparatus as used in Example 3, a 25% by weight solution of trimethylethylammonium hydrogencarbonate in ultra pure water was cycled in the anode compartment, and in the cathode compartment, a 0.5% by weight solution of trimethylethylammonium hydroxide in ultra pure water was cycled in the cathode compartment. Electrolysis was carried out by applying a DC current of 10 A/dm$^2$ between the anode and the cathode at a temperature of 40° C. At an electrolytic voltage of 8 to 11 V and an average current efficiency of 91%, a 21.24% by weight aqueous solution of trimethylethylammonium hydroxide was obtained in the cathode compartment.

The concentrations of impurities in the aqueous trimethylethylammonium solution as obtained above are shown below:

Na, Fe: 0.002 ppm
Ca, K, Ni, Zn: 0.001 ppm
Al, Ag, Co, Cr, Mg, Mn: Less than 0.001 ppm
Cl: Less than 0.01 ppm

PREPARATION EXAMPLE 7

The trimethylethylammonium hydrogencarbonate used in Example 8 was prepared as follows.

114.1 g of trimethylethylammonium monomethylcarbonate and 75.6 g of water were introduced in the same reactor as used in Preparation Example 1 and heated with stirring. After the temperature in the reactor reached 120° C., the reaction was continued for 3 hours at 120° C. Trimethylethylammonium hydrogencarbonate was obtained in a yield of 96.3 mol %.

PREPARATION EXAMPLE 8

88.5 g of tetramethylammonium isopropylcarbonate and 45.0 g of water were introduced in the same reactor as used in Preparation Example 1 and heated with stirring. After the temperature reached 120° C., the reaction was continued for 3 hours at 120° C. Tetramethylammonium hydrogencarbonate was obtained in a yield of 95.0 mol %.

What is claimed is:

1. A process for producing a high purity quaternary ammonium hydroxide which comprises hydrolyzing a quaternary ammonium hydrogencarbonate represented by the general formula (I):

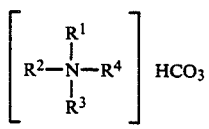

(I)

wherein $R^1$, $R^2$, $R^3$ and $R^4$ may be the same or different and are each an alkyl group or hydroxyalkyl group having 1 to 8 carbon atoms, an alkoxyalkyl group having 2 to 9 carbon atoms, or an aryl group or hydroxyaryl group. In an electrolytic cell comprising an anode compartment and a cathode compartment defined by a cation exchange membrane.

2. The process as claimed in claim 1 wherein the cation exchange membrane is made of a fluorine-containing polymer or a styrene-divinylbenzene copolymer, having cation exchange groups.

3. The process as claimed in claim 2 wherein the cation exchange membrane is made of a fluorine-containing polymer having cation exchange groups.

4. The process as claimed in claim 3 wherein the anode is a carbon electrode or a platinum or platinum oxide-coated titanium electrode.

5. The process as claimed in claim 3 wherein the cathode is a stainless steel electrode or a nickel electrode.

6. The process as claimed in claim 1 wherein the electrolytic cell is made of a corrosion-resistant material.

7. The process as claimed in claim 6 wherein the corrosion-resistant material is a fluorine-containing polymer or polypropylene.

8. The process as claimed in claim 1 wherein the electrolysis is carried out at a current density of 1 to 100 A/dm$^2$.

9. The process as claimed in claim 8 wherein the current density is 3 to 50 A/dm$^2$.

10. The process as claimed in claim 1 wherein the electrolysis is carried out at a temperature of 10° to 50° C.

11. The process as claimed in claim 1 wherein the quaternary ammonium hydrogencarbonate is introduced in the anode compartment.

12. The process as claimed in claim 11 wherein the quaternary ammonium hydrogencarbonate is introduced as a 1 to 60% by weight aqueous solution.

13. The process as claimed in claim 12 wherein the concentration of the quaternary ammonium hydrogencarbonate is 3 to 40% by weight.

14. The process as claimed in claim 1 wherein water is introduced in the cathode compartment.

15. The process as claimed in claim 14 wherein the water contains 0.01 to 5% by weight of the quaternary ammonium hydroxide.

16. The process as claimed in claim 14 or 15 wherein the water is ultra pure water.

17. The process as claimed in claim 1 wherein the quaternary ammonium hydrogencarbonate is selected from the group consisting of tetramethylammonium hydrogencarbonate, tetraethylammonium hydrogencarbonate, tetrapropylammonium hydrogencarbonate, trimethylpropylammonium hydrogencarbonate, trimethylbutylammonium hydrogencarbonate, trimethylbenzylammonium hydrogencarbonate, trimethylhydroxyethylammonium hydrogencarbonate, trimethylmethoxyammonium hydrogencarbonate, dimethyldiethylammonium hydrogencarbonate, dimethyldihydroxyethylammonium hydrogencarbonate, methyltriethylammonium hydrogencarbonate, and methyltrihydroxyethylammonium hydrogencarbonate.

18. The process as claimed in claim 1 wherein the quaternary ammonium hydrogencarbonate is prepared by reacting a tertiary amine represented by the general formula:

$$(R^1R^2R^3)_3N$$

wherein $R^1$, $R^2$ and $R^3$ may be the same or different and are each an alkyl group or hydroxyalkyl group having 1 to 8 carbon atoms, an alkoxyalkyl group having 2 to 9 carbon atoms, or an aryl group or hydroxyaryl group, and a dialkyl carbonate or diaryl carbonate represented by the general formula:

$$R^4OCOR^5 \quad (\text{with } \| \text{ O})$$

wherein $R^4$ is an alkyl group or hydroxyalkyl group having 1 to 8 carbon atoms, an alkoxyalkyl group having 2 to 9 carbon atoms, or an aryl group or hydroxyaryl group, and $R^5$ is an alkyl group having 1 to 8 carbon atoms or an aryl group, in the presence of water.

19. The process as claimed in claim 18 wherein the molar ratio of the dialkyl carbonate or diaryl carbonate to the tertiary amine is 0.05:1 to 20:1.

20. The process as claimed in claim 19 wherein the molar ratio of the dialkyl carbonate or diaryl carbonate to the tertiary amine is 0.1:1 to 10:1.

21. The process as claimed in claim 18 wherein the water is used in a stoichiometrically excessive amount in relation to the dialkyl carbonate or diaryl carbonate, or the tertiary amine.

22. The process as claimed in claim 1 wherein the quaternary ammonium hydrogencarbonate is prepared by reacting a quaternary ammonium monoalkylcarbonate or quaternary ammonium monoarylcarbonate represented by the general formula:

$$\left[ R^2-\overset{\overset{R^1}{|}}{\underset{\underset{R^3}{|}}{N}}-R^4 \right] OCOR^5 \quad (\text{with } \| \text{ O})$$

wherein Rhu 1, $R^2$, $R^3$ and $R^4$ may be the same or different and are each an alkyl group or hydroxyalkyl group having 1 to 8 carbon atoms, an alkoxyalkyl group having 2 to 9 carbon atoms, or an aryl group or hydroxyaryl group, and R5 is an alkyl group having 1 to 8 carbon atoms or an aryl group with water.

23. The process as claimed in claim 22 wherein the water is used in a stochiometrically excessive amount in relation to the quaternary ammonium monoalkylcarbonate or quaternary ammonium monoarylcarbonate.

24. The process as claimed in claim 23 wherein the molar ratio of the water to the quaternary ammonium monoalkylcarbonate or quaternary ammonium monoarylcarbonate is 2:1 to 30:1.

25. The process as claimed in claim 18 or 22 wherein the reaction is carried out in a polar solvent.

26. The process as claimed in claim 25 wherein the polar solvent is selected from the group consisting of aliphatic lower alcohols, monohydric aromatic alcohols, glycols, acid amides and nitriles.

27. The process as claimed in claim 26 wherein the polar solvent is methanol, ethanol, propanol or acetonitrile.

28. The process as claimed in claim 18 or 22 wherein the reaction is carried out at a temperature of 40° to 250° C.

29. The process as claimed in claim 28 wherein the reaction temperature is 50° to 200° C.

30. The process as claimed in claim 18 or 22 wherein Rhu 1, $R^2$, $R^3$ and $R^4$ are each an alkyl group having 1 to 4 carbon atoms.

31. A process for producing high purity quaternary ammonium hydroxide which comprises:

reacting a tertiary amine represented by the general formula:

$$(R^1R^2R^3)_3N$$

wherein Rhu 1, $R^2$ and $R^3$ may be the same or different and are each an alkyl group or hydroxyalkyl group having 1 to 8 carbon atoms, an alkoxyalkyl group having 2 to 9 carbon atoms, or an aryl group or hydroxyaryl group and a dialkyl carbonate or diaryl carbonate represented by the general formula:

$$R^4OCOR^5 \quad (\text{with } \| \text{ O})$$

wherein $R^4$ is an alkyl group or hydroxyalkyl group having 1 to 8 carbon atoms, an alkoxyalkyl group having 2 to 9 carbon atoms, or an aryl group or hydroxyaryl group, and $R^5$ is an alkyl group having 1 to 8 carbon atoms or an aryl group in the presence of water to form a quaternary ammonium hydrogencarbonate represented by the general formula:

$$\left[ R^2-\overset{\overset{R^1}{|}}{\underset{\underset{R^3}{|}}{N}}-R^4 \right] HCO_3$$

wherein $R^1$, $R^2$, $R^3$ and $R^4$ are the same as defined above, and electrolyzing the above quaternary ammonium hydrogencarbonate in an electrolytic cell comprising an anode compartment and a cathode compartment defined by a cation exchange membrane.

32. The process as claimed in claim 31 wherein the reaction between the tertiary amine and the dialkyl carbonate or diaryl carbonate is carried out in a polar solvent.

33. The process as claimed in claim 32 wherein the polar solvent is an aliphatic lower alcohol having 1 to 4 carbon atoms.

* * * * *